US010965011B2

(12) United States Patent
Elshaar

(10) Patent No.: US 10,965,011 B2
(45) Date of Patent: Mar. 30, 2021

(54) HIGH FREQUENCY ANTENNA CARRIER IN VEHICLE ROOF CROSS MEMBER

(71) Applicant: Ficosa North America Corporation, Madison Heights, MI (US)

(72) Inventor: Bassel Elshaar, Commerce Township, MI (US)

(73) Assignee: Ficosa North America Corporation, Madison Heights, MI (US)

( * ) Notice: Subject to any disclaimer, the term of this patent is extended or adjusted under 35 U.S.C. 154(b) by 0 days.

(21) Appl. No.: 16/540,164

(22) Filed: Aug. 14, 2019

(65) Prior Publication Data

US 2020/0058988 A1 Feb. 20, 2020

Related U.S. Application Data

(60) Provisional application No. 62/764,939, filed on Aug. 16, 2018.

(51) Int. Cl.
*H01Q 1/32* (2006.01)

(52) U.S. Cl.
CPC ..... *H01Q 1/3275* (2013.01); *H01Q 1/3208* (2013.01); *H01Q 1/3291* (2013.01)

(58) Field of Classification Search
CPC .. H01Q 1/3275; H01Q 1/3285; H01Q 1/3291; H01Q 1/42; H01Q 1/405; H01Q 21/30; B60R 2011/0028; B60R 13/0212; B60R 13/0231; B60R 9/04; B60J 7/1642
See application file for complete search history.

(56) References Cited

U.S. PATENT DOCUMENTS 6,900,769 B2 * 5/2005 Schlieber ..... H01Q 1/3275 343/713
7,755,551 B2 * 7/2010 Lindackers ..... H01Q 1/42 343/713
2019/0348754 A1 * 11/2019 Apostolos ..... H01Q 9/0442

* cited by examiner

*Primary Examiner* — Vibol Tan
(74) *Attorney, Agent, or Firm* — Brooks Kushman P.C.

(57) ABSTRACT

A high frequency antenna carrier in vehicle roof cross member is provided. The antenna carrier is configured to extend width-wise across a vehicle roof to provide structural support for the vehicle roof. The antenna carrier has a lower surface, and a plurality of sidewalls that meet at a common upper flange that mates in a face-to-face relationship with the vehicle roof. The sidewalls may be provided with apertures to facilitate a strong signal passage to and from the high frequency antenna through the carrier. The lower surface of the antenna carrier may be provided with apertures that are aligned with the antennas to improve signal strength.

18 Claims, 10 Drawing Sheets

HIGH FREQUENCY ANTENNA CARRIER IN VEHICLE ROOF CROSS MEMBER

CROSS-REFERENCE TO RELATED APPLICATIONS

This application claims the benefit of U.S. provisional application Ser. No. 62/764,939 filed Aug. 16, 2018, the disclosure of which is hereby incorporated in its entirety by reference herein.

TECHNICAL FIELD

This disclosure generally relates to a carrier for high frequency antennas. More specifically, this disclosure relates to a high frequency antenna carrier that supports a roof of a motor vehicle.

BACKGROUND

Modem vehicles may include a plethora of antennas, transmitters, receivers, and/or transceivers for various wireless technologies, such as telephone, Vehicle-to-Vehicle (V2V), Vehicle-to-Cloud or Vehicle-to-Everything (V2X), Global Navigation Satellite Systems (GNSS), Satellite Digital Audio Radio Service (SDARS), Remote Key Entry (RKE), telecommunication and Multi-Input Multi-Output (MIMO) operable over one or more frequency bands (e.g., 5G, 4G, 3G, other Long-Term Evolution (LTE) generations, WiFi, AM/FM/Digital Audio Broadcasting (DAB), and others). The antennas are typically integrated into the rear-view mirror, the front windshield, the rear windshield or window, bumpers or fascia, the dashboard, or above the roof (e.g., a shark fin antenna).

DETAILED DESCRIPTION

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

It should be understood that directional terms used herein are for illustrative purposes and refer to the direction relative to a vehicle in a normal, upright direction unless otherwise indicated. For example, a roof having a "lower" surface means that the surface faces toward the lower side of the vehicle.

Figure 1:
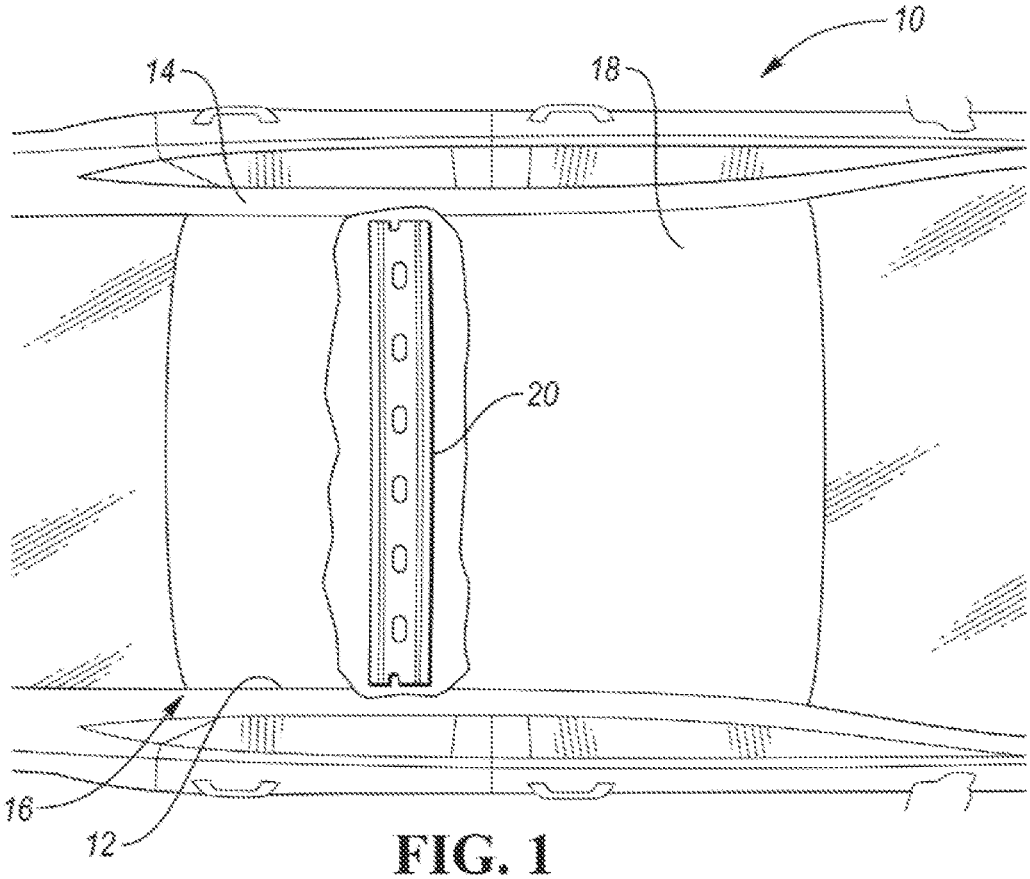
FIG. 1 (PRIOR ART)
FIG. 1 is a top perspective view of a vehicle roof cross-beam support member in a prior art vehicle.

FIG. 1 shows a roof structure 10 of an automotive vehicle. The automotive vehicle may be a passenger vehicle such as a car, sports utility vehicle, van, crossover, pickup truck or the like. The roof structure includes a first side 12 and a second side 14. The sides 12, 14 can connect to and be supported by pillars. For example, a B-pillar or C-pillar may attach to the first side 12 at a connection point 16. The roof structure may be made from stamped steel or aluminum, for example. A roof 18 attaches over the outside of the roof structure and defines an extreme outer surface of the vehicle, i.e., the top of the vehicle.

Roof structures typically have cross beams to support the roof. FIG. 1 shows such a cross beam. For example, a cross beam 20 (also referred to as a roof cross member) extends across the roof structure 10 width-wise, from the first side 12 to the second side 14. The roof cross member 20 is configured to support the roof and the structural integrity of the roof structure. The roof cross member 20 provides various benefits, such as helping to support the sheet metal, inhibiting caving of the roof when subjected to weight or pressure, as well as protecting the vehicle occupants in the event of a rollover accident.

As explained in the Background, modern vehicles can be equipped with a plethora of antennas. Packaging space is of importance for these antennas.

Therefore, according to various embodiments disclosed herein, an antenna carrier is provided. The antenna carrier can replace a cross beam, such as the cross beam 20 of FIG. 1. The antenna carrier can house an antenna module with a plurality of the high-frequency antennas described above in a single, compact location that is flush and seamless with the vehicle roof.

Figure 2:
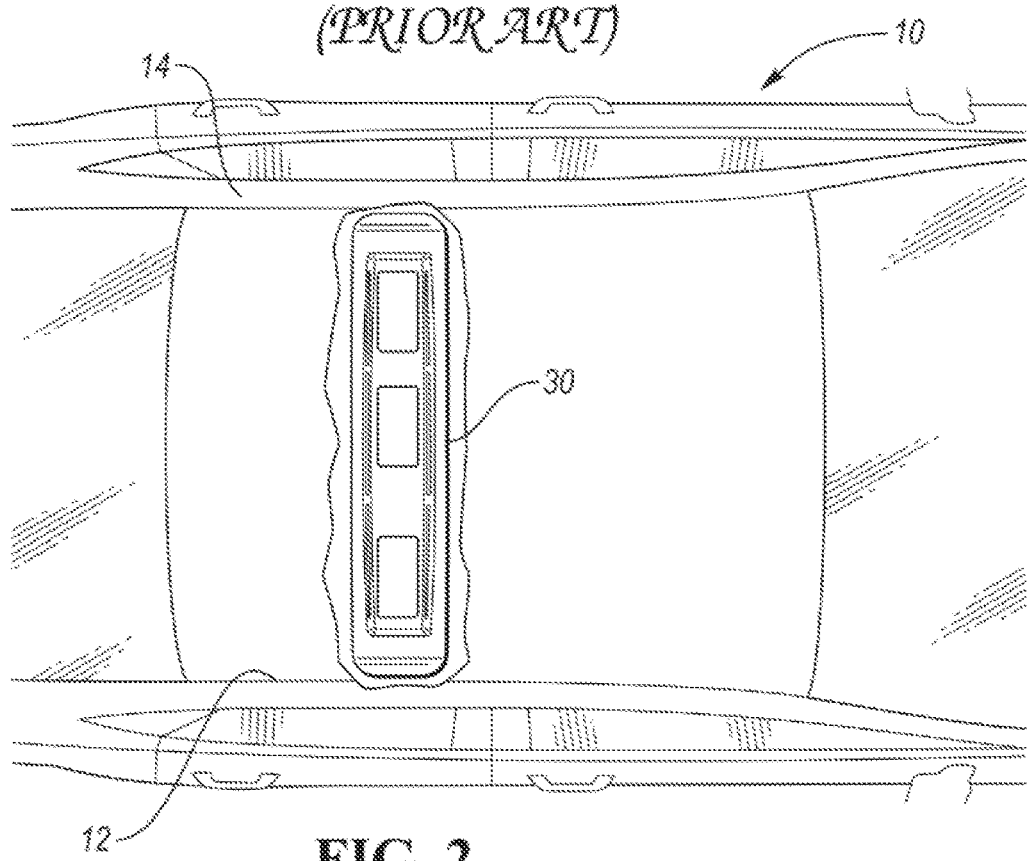
FIG. 2 is a top perspective view of a vehicle roof having an antenna carrier (e.g., high frequency antenna carrier) integrated into or supporting the roof structure and replacing the vehicle roof cross-beam support member of FIG. 1, according to one embodiment.
Figure 3:
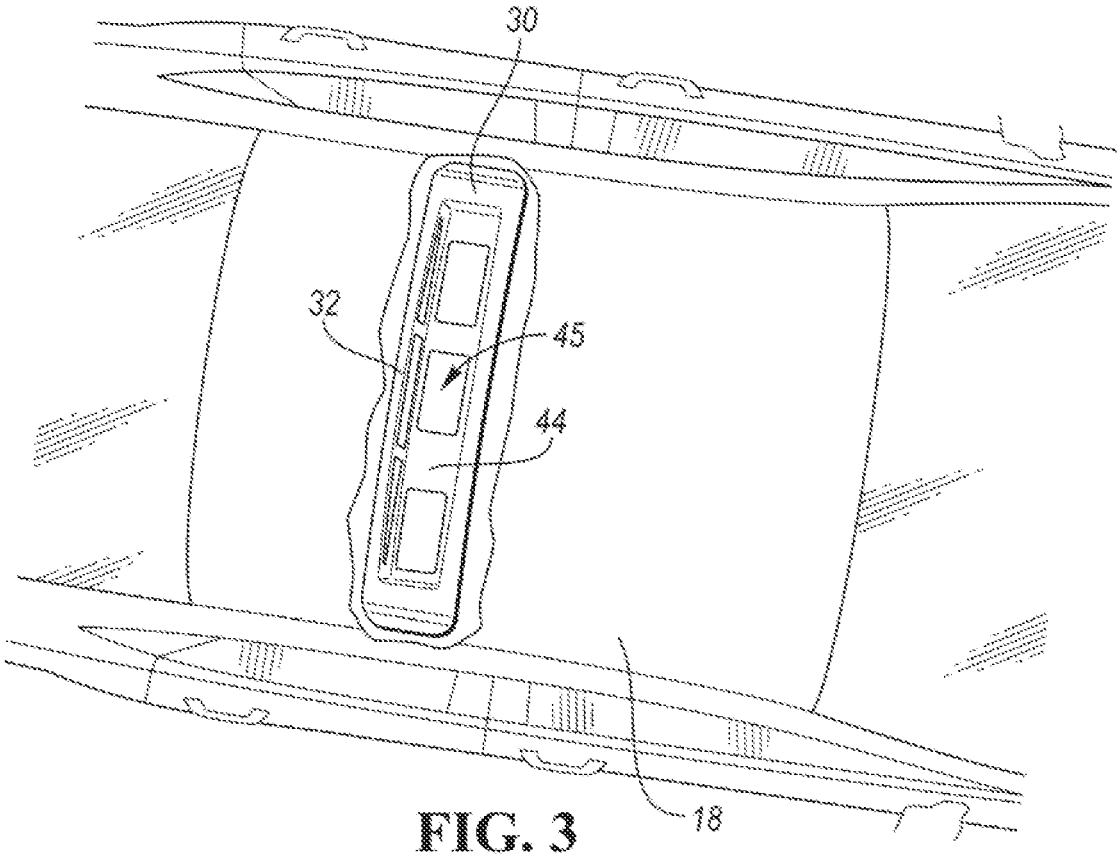
FIG. 3 is another top perspective view of a vehicle roof having an antenna carrier (e.g., high frequency antenna carrier) integrated into or supporting the roof structure, according to one embodiment.
Figure 4:
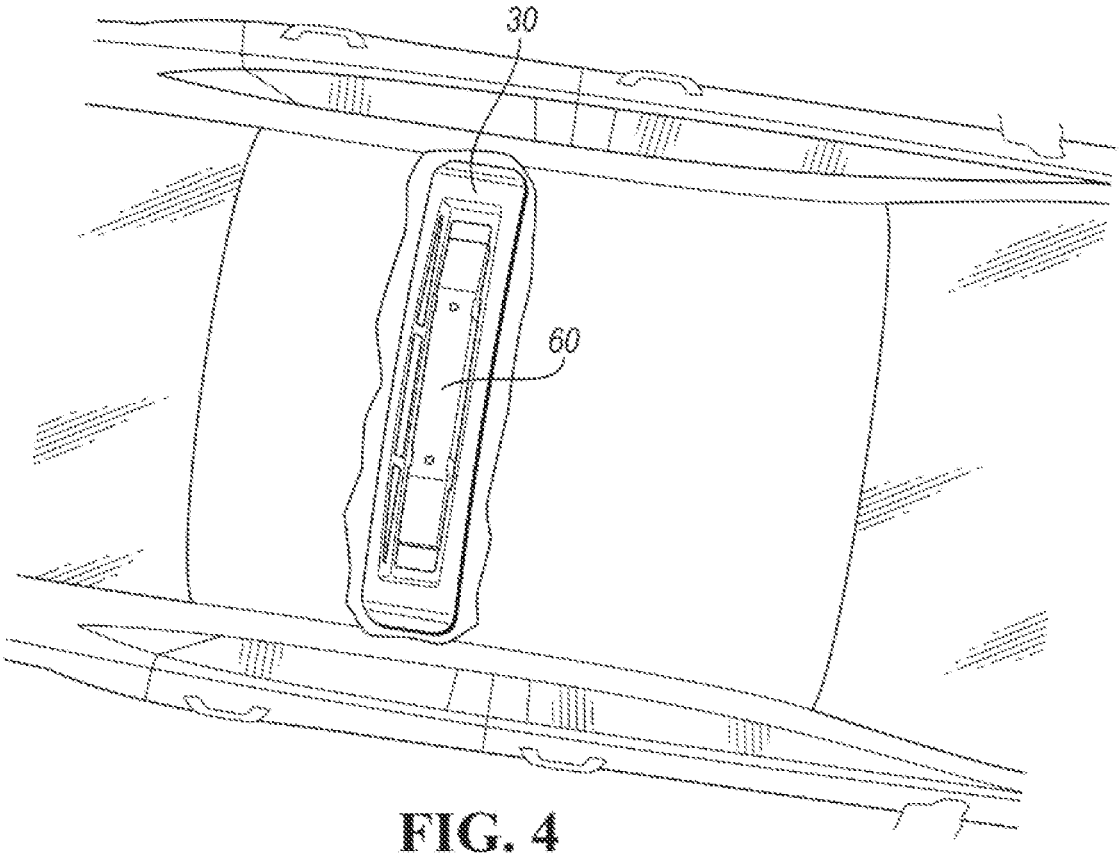
FIG. 4 is a top perspective view of the roof and antenna carrier of FIG. 3, with a high frequency antenna module attached to the carrier, according to one embodiment.
Figure 5:
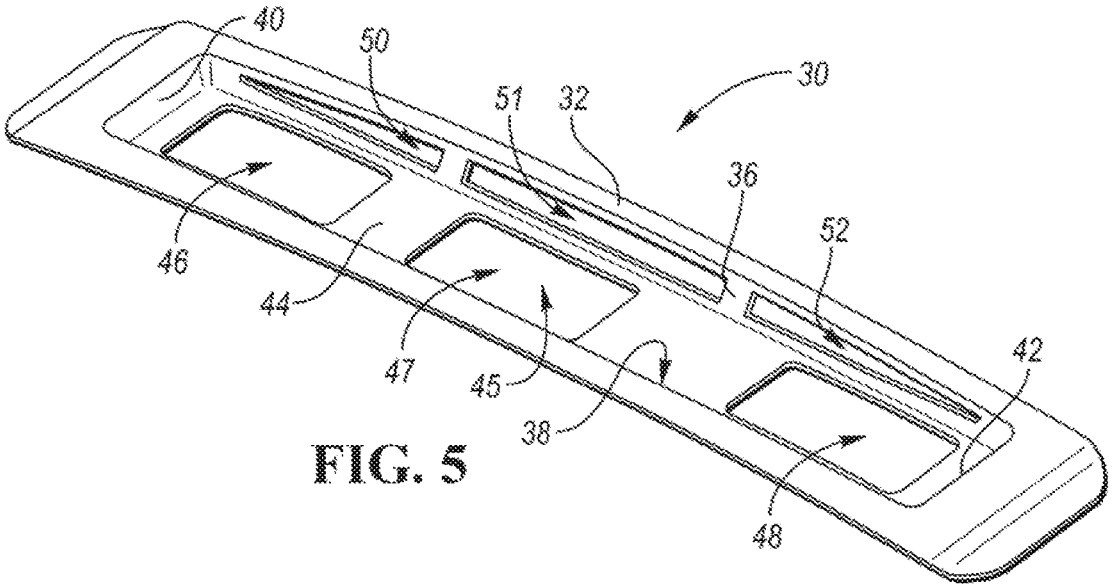
FIG. 5 is a top perspective view of the antenna carrier in isolation, according to one embodiment.

FIGS. 2-4 show various views of the antenna carrier connected to and supporting the roof, while FIG. 5 shows the antenna carrier in isolation. One embodiment of the antenna carrier is labeled as reference number 30. The antenna carrier 30 has an upper flange 32 that is flush with and conforms to an underside of the roof 18. The antenna carrier 30 can also attach to the sides 12, 14 of the roof structure. Therefore, the antenna carrier 30 can be referred to as an antenna carrier roof support member, or the like. A headliner can extend throughout the interior of the vehicle, covering the underside of the roof and extending over the interior-facing surface of the flange 32. This creates a seamless transition with the interior of the roof and the underside of the antenna carrier 30.

The antenna carrier 30 has a plurality of sidewalls extending downward toward the interior of the vehicle. For example, referring to FIG. 5, the antenna carrier 30 can have a front wall 36, a rear wall 38 that opposes the front wall 36, and a pair of opposing sidewalls 40, 42 on either lateral side of the antenna carrier 30. The walls 36, 38, 40, 42 extend downward from the flange 32. The walls 36, 38, 40, 42 all end at the flange 32 which is a common flange extending from these walls, and defines an upper extremity or perimeter of the antenna carrier 30. A lower surface 44 extends between and connects lower ends of the walls 36, 38, 40, 42. The lower surface 44 along with the walls 36, 38, 40, 42 collectively define a cavity or pocket 45 of the antenna carrier 30.

FIG. 4 shows the antenna carrier 30 at least partially housing an antenna module 60, which is described below. And, as shown in FIGS. 2-5, the lower surface 44 of the antenna carrier 30 can have openings beneath the antenna module 60 for beam forming or signal tuning of the antennas in the antenna module. For example, in one embodiment the lower surface 44 has a plurality of openings or apertures (e.g., first aperture 46, second aperture 47, third aperture 48) defined therein, extending entirely through the lower surface 44. These openings or apertures 46-48 can be aligned with a respective one of the antennas in the antenna module 60 such that the openings are configured for beam forming and signal tuning of the antennas for optimum signal quality and strength. For proper alignment with the antennas in the antenna module, the openings 46-48 may be aligned such that the first opening 46 and the second opening 47 are closer together than the second opening 47 and the third opening 48. To provide optimum signal quality and strength, the amount of surface area of the collective openings 46, 47, 48 on the lower surface 44 can be more than 50 percent. In other words, a surface area of the openings 46, 47, 48 can exceed a surface area of the material that makes up the lower surface 44 (e.g., a majority of the lower surface has a removal or lack of material). The amount of surface area of the collective openings 46, 47, 48 on the lower surface 44 can be more or less than 50 percent depending on design needs, with an increased surface area of the openings yielding more optimized antenna performance but less structural integrity, and vice versa. The openings or apertures 46, 47, 48 can be relatively large compared to the material of the lower surface 44. Each opening 46, 47, 48 can span almost the entire width of the lower surface 44 (e.g., over 80 percent of the distance between walls 36 and 38, and in some embodiments, over 90 percent of the distance). Again, more or less than 80 percent can be implemented according to different design needs, with an increased surface area of the openings yielding more optimized antenna performance but less structural integrity, and vice versa. The combined length of the openings 46, 47, 48 also exceeds the combined length of the remaining material of the lower surface 44. In other words, going from side wall 40 to side wall 42, there is more lack of material (e.g., opening) than there is material of the lower surface 44.

Figure 16:
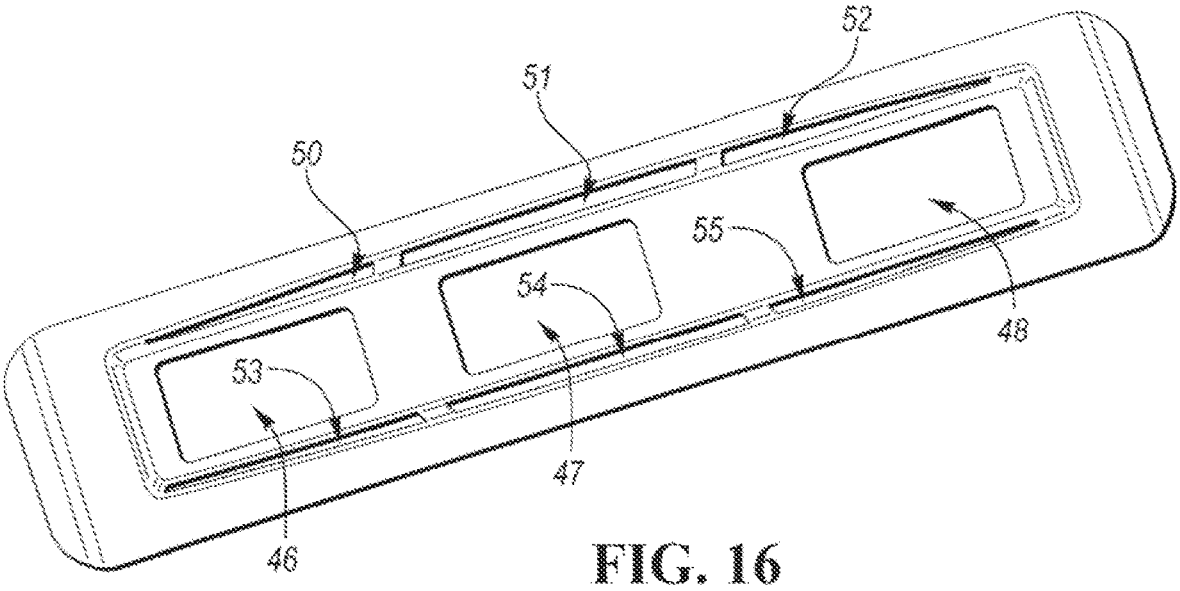
FIG. 16 is another view (e.g., top perspective view) of the antenna carrier in isolation, according to one embodiment.

The front wall 36 can also have three openings 50, 51, 52, and the rear wall 38 can likewise have three openings 53, 54, 55 (as seen in FIG. 16). These openings 50-55 are also configured for beam forming and signal tuning of the antennas for optimum signal quality and strength. To provide optimum signal quality and strength, the amount of surface area of the collective openings 50, 51, 52 on the front wall 36 can be more than 50 percent. In other words, a majority of the front wall 36 is a lack of material created by the openings. Again, the amount of surface area of the collective openings 50, 51, 52 on the front wall 36 can be more or less than 50 percent depending on design needs, with an increased surface area of the openings yielding more optimized antenna performance but less structural integrity, and vice versa. This can also be true for the rear wall 38. Having a majority of the front and rear walls 36, 38 being provided with openings or lack of materials enables the signal quality and strength from the antenna to be minimally disturbed, and also creates pathways for the signals to exit and enter the antenna carrier 30 during wireless communication. The openings 50, 52, 53, 55 may be triangular or wedge-shaped to conform to the sloping shape of the antenna carrier 30, while the central openings 51, 54 may be rectangular in shape. To improve structural rigidity while still not interfering with the signal path from the antenna within the carrier 30, the side walls 40, 42 may be entirely solid without any apertures.

Figure 6:
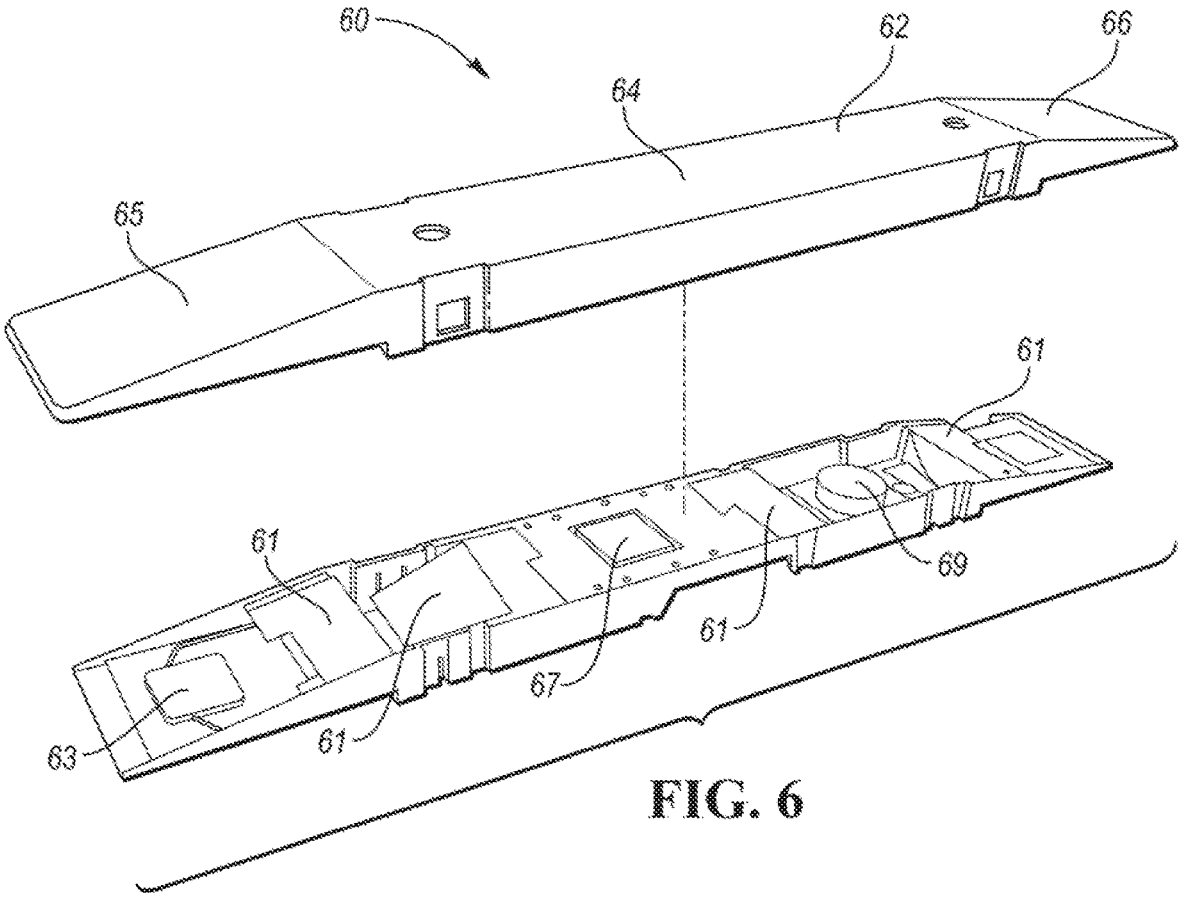
FIG. 6 is a partial-exploded perspective view of a high frequency antenna module for attachment within or to the antenna carrier, according to one embodiment.

A high frequency antenna module 60 is sized and configured to be contained within the pocket 45 of the antenna carrier 30, between the vehicle's outer roof and the lower surface 44. The module 60 is shown in FIG. 6, attached in the pocket 45 to the lower surface 44. In particular, the antenna module 60 can mount to the regions between the apertures (described below) via a fastener such as a screw, bolt, etc.

FIG. 6 shows an exploded perspective view of the high frequency antenna module 60. As can be seen, the module 60 takes a generally flat profile to fit within the confines of the pocket 45. In particular, the module 60 includes an outer housing or shell 62 with a generally planar upper surface 64, and tapered or sloped opposing side surfaces 65, 66. When attached to the antenna carrier 30, the antenna module may be spaced from (i.e., not directly touch) the walls 36, 38, 40, 42.

The antenna module 60 may have several antennas, transceivers, etc. located within. For example, as labeled in FIG. 6, the module 60 can include a MIMO 5G-sub6 antenna system including one or more of the following components: 5G Sub6 (LTE+WiFi+5G Sub6 foil antenna) 61, vehicle-to-everything (V2X) antenna 63, Satellite Digital Audio Radio Service (SDARS) active antenna 67, and GNSS L1+L2 antenna 69. Other antennas, such as those described above, can also be included. The antennas can be aligned with a corresponding one of the apertures disclosed above for signal tuning and beam forming. For example, opening 46 can be vertically aligned with the V2X antenna and one of the 5G Sub6 antennas, opening 47 can be vertically aligned with the SDARS antenna and two of the 5G Sub6 antennas, and opening 48 can be vertically aligned with the GNSS L1+L2 antenna and one of the 5G Sub6 antennas. The openings 50-55 can be horizontally aligned with the antennas. The openings remove material that might otherwise interfere or degrade the signal coming from and going to the antennas. In one embodiment, the antennas are connected to a point that is on the boundary of one of the apertures 46-48.

The regions between the apertures 46-48 can vary in width to accommodate the shape, size, position and/or location of the antennas in the module 60. In the embodiment shown in FIG. 2-5, the width of the region between apertures 46 and 47 is different than the width of the region between apertures 47 and 48. These size differences may also be provided to account for the necessary locations of the capacitive or direct ground connections shown in FIG. 7.

Figure 7:
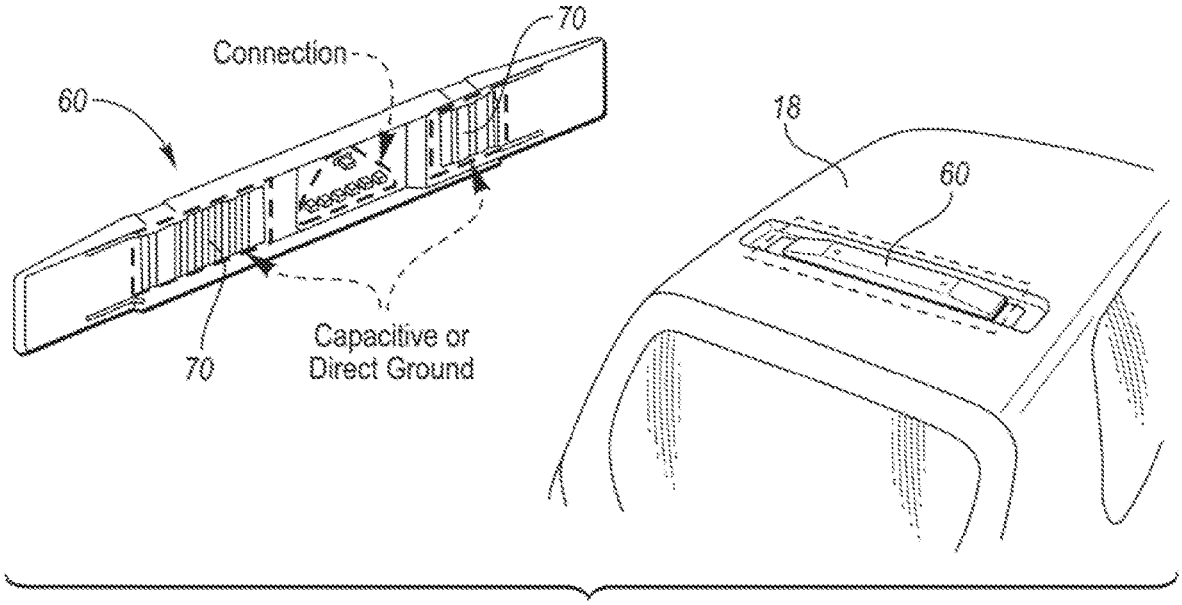
FIG. 7 is another partial-exploded perspective view of the high frequency antenna module, showing the bottom of the module and its attachment and positioning relative to a vehicle, according to one embodiment.

FIG. 7 shows the underside of the antenna module 60, with antenna module ground structure 70, such as metal (e.g., aluminum or steel) or conductive composite material (e.g., woven fiberglass, glass-reinforced epoxy laminate, or FR4 PCB), that provides a capacitive or direct ground connection with the underlying antenna carrier 30, which can also be metal (e.g., aluminum or steel), to facilitate the capacitive connection or grounding. In an embodiment, the antenna carrier 30 may be a non-conductive composite material, and the antenna module ground structure 70 may be metal and may be considered the grounding for the antenna module 60, and thus no additional grounding may be needed. In embodiments, the antenna carrier 30 can be connected to the surrounding roof structure which is ultimately connected to the vehicle chassis to further facilitate the capacitive connection or grounding.

Figure 8:
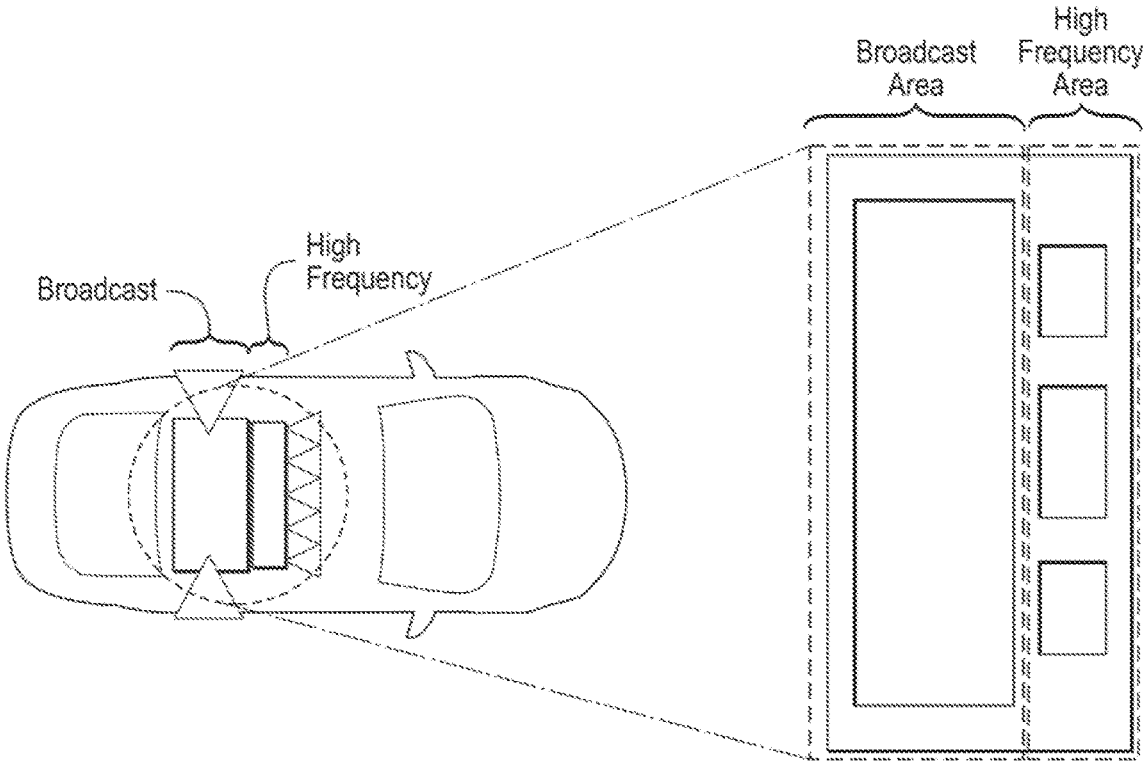
FIG. 8 is a schematic view of the antenna carrier and a high frequency antenna module, adjacent a low-frequency or broadcast area of the vehicle, according to one embodiment.

FIG. 8 shows one example of the location of the high frequency antenna module on a vehicle and relative to a broadcast (e.g., low frequency) location. The high frequency antenna module 60 may be located directly adjacent and forward of the low frequency area or module. The broadcast or low frequency module can include antennas for AM, FM, FM diversity, DAB, DAB diversity, and TV.

In another embodiment, one or more of the broadcast antennas can be included in the high-frequency antenna module 60 to form a singular, unitary packaged module with both high-frequency and low-frequency antennas.

Figure 9:
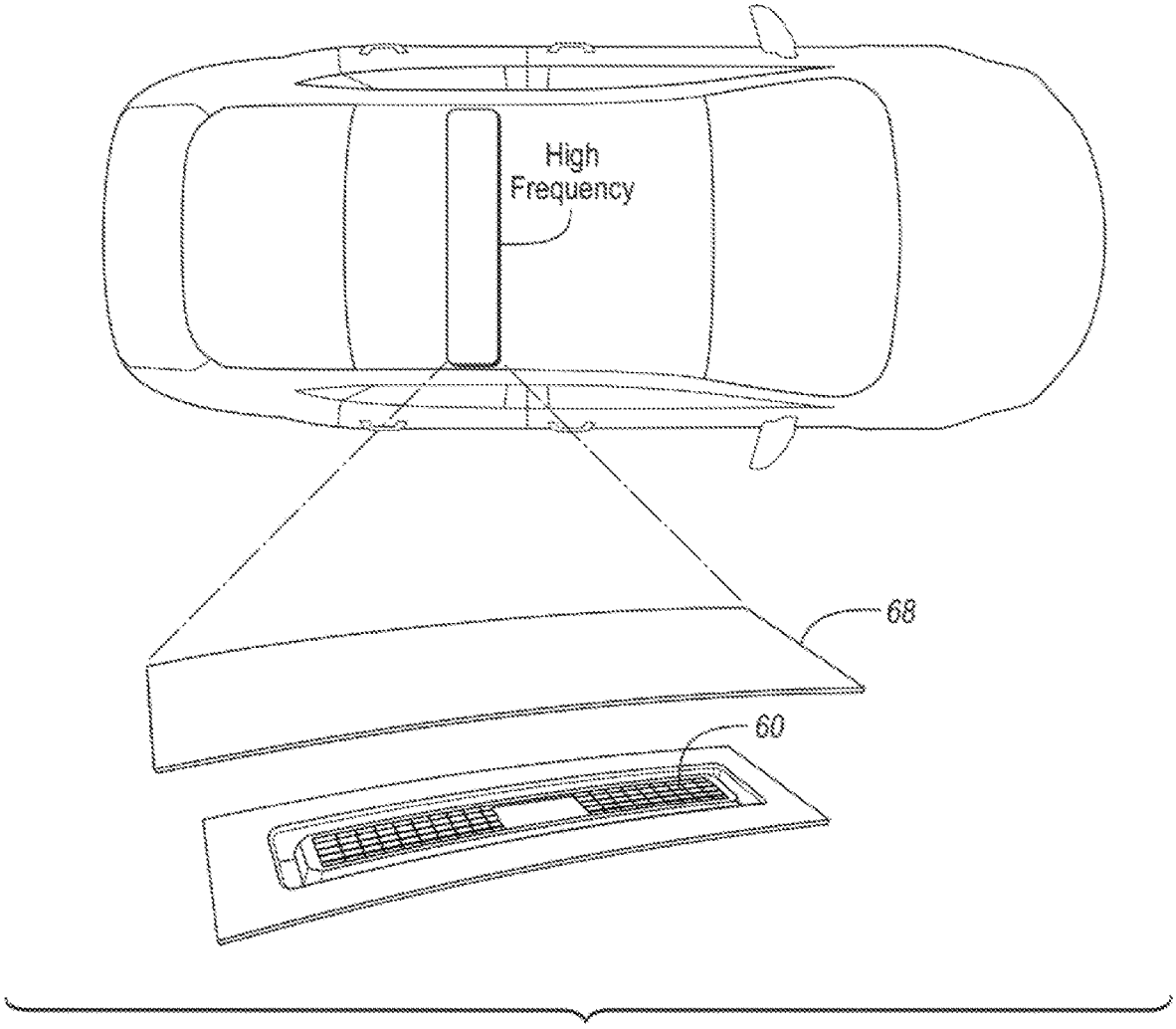
FIG. 9 is a top view of the high frequency region of the vehicle, and an exploded view of the roof and the underlying high frequency antenna module in the high frequency region of the vehicle, according to one embodiment.

FIG. 9 shows an example of the location of the high frequency antenna module 60, and an example of an exploded view of its implementation. In one embodiment, a cover 68, such as a glass (e.g., dark or low-transparency) or non-metal composite, is placed over the antenna module as part of a seamless outer roof of the vehicle.

Figure 10:
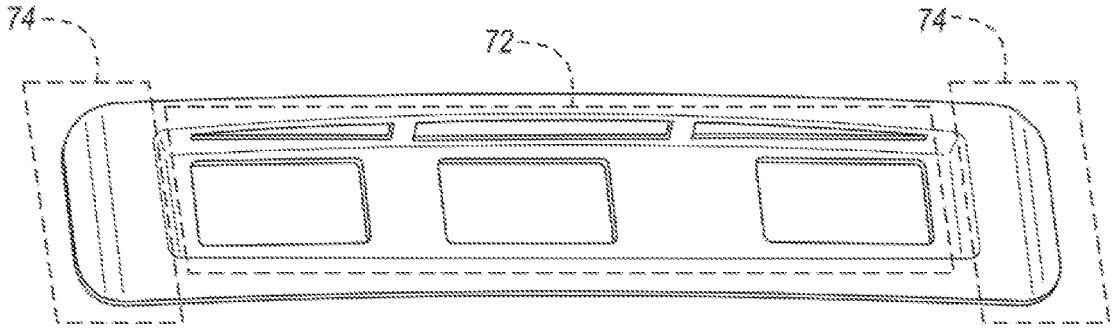
FIG. 10 is a perspective view of the antenna carrier with some regions of the antenna carrier that can be consistent across multiple platforms and vehicle designs, and other regions of the antenna carrier that can be modified to fit the multiple platforms or vehicle designs, according to one embodiment.

The antenna carrier 30 is designed such that a substantial portion of the carrier 30 can remain the same dimensions over all vehicle platforms, while a smaller portion of the carrier 30 can be modified to fit the desired vehicle platform. For example, as shown in FIG. 10, the central region 72 of the antenna carrier 30, including the apertures in the lower surface and walls, can remain identical for all vehicle designs. To accommodate implementing the antenna carrier 30 into various vehicles, the flange regions 74 on either side of the carrier 30 can be shaped, sized and configured differently depending on the width, curvature, and shape of the vehicle to which the carrier 30 is being integrated. In other words, the central region 72 can remain the same and utilize a common design tailored for optimum antenna performance and robust scalable content integration, while the flange regions can be changed depending on vehicle platform constraints.

Figure 11:
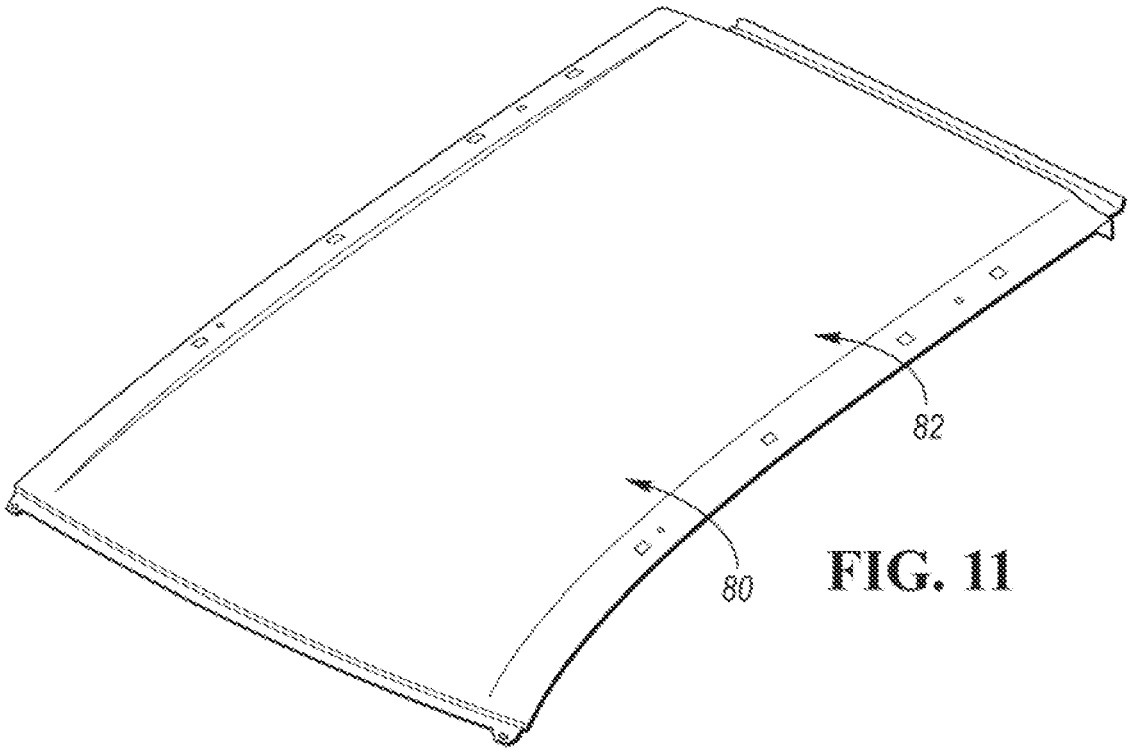
FIG. 11 is a top perspective view of a vehicle roof, according to one embodiment.
Figure 12:
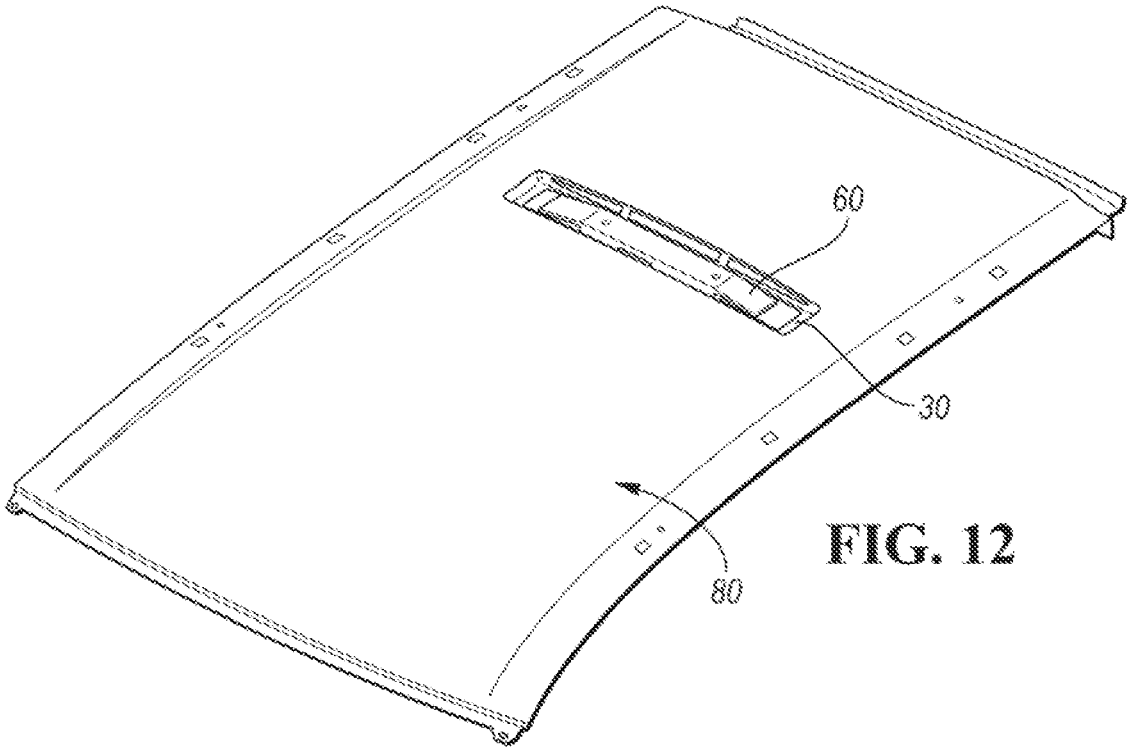
FIG. 12 is a top perspective view of the vehicle roof with a top portion (e.g., glass or non-metal composite) removed to show the antenna module and the antenna carrier, according to one embodiment.

FIGS. 11-15 show perspective views of a roof assembly with various components being removed sequentially to illustrate the interconnectivity and location of the components. FIG. 11 shows a roof 80 defining an outer surface and boundary of the vehicle. The roof has a region 82 that overlies the antenna carrier 30 and antenna module 60. That region can be glass, such as darkened, low-transparency glass, or non-metal composite. FIG. 12 shows the roof 80 with the region 82 removed, exposing the underlying antenna carrier 30 and antenna module 60.

Figure 13:
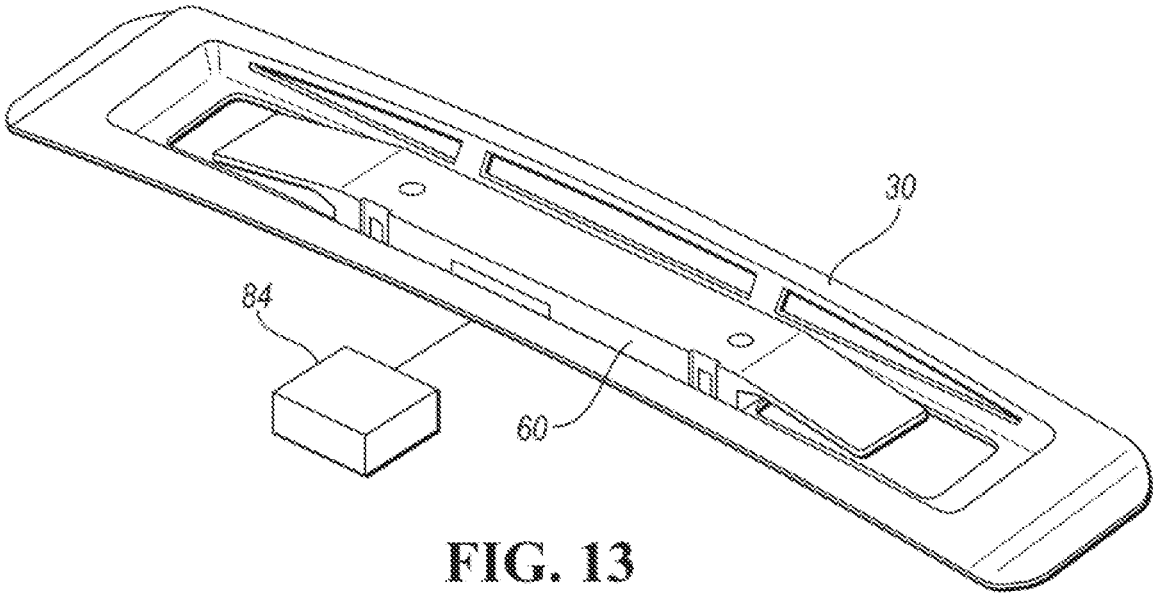
FIG. 13 is a perspective view of the antenna module connected to the antenna carrier and a telematic control unit (TCU), according to one embodiment.

FIG. 13 shows the antenna carrier 30 and connected antenna module 60, along with a telematic control unit (TCU) 84. The antenna module 60 and its various antennas electrically connect to the TCU 84, which processes and/or routes the data signals from the antennas to other control systems within the vehicle (e.g., autonomous control modules, communication systems, signal routers, navigation or location modules, telecommunication modules, etc.).

Figure 14:
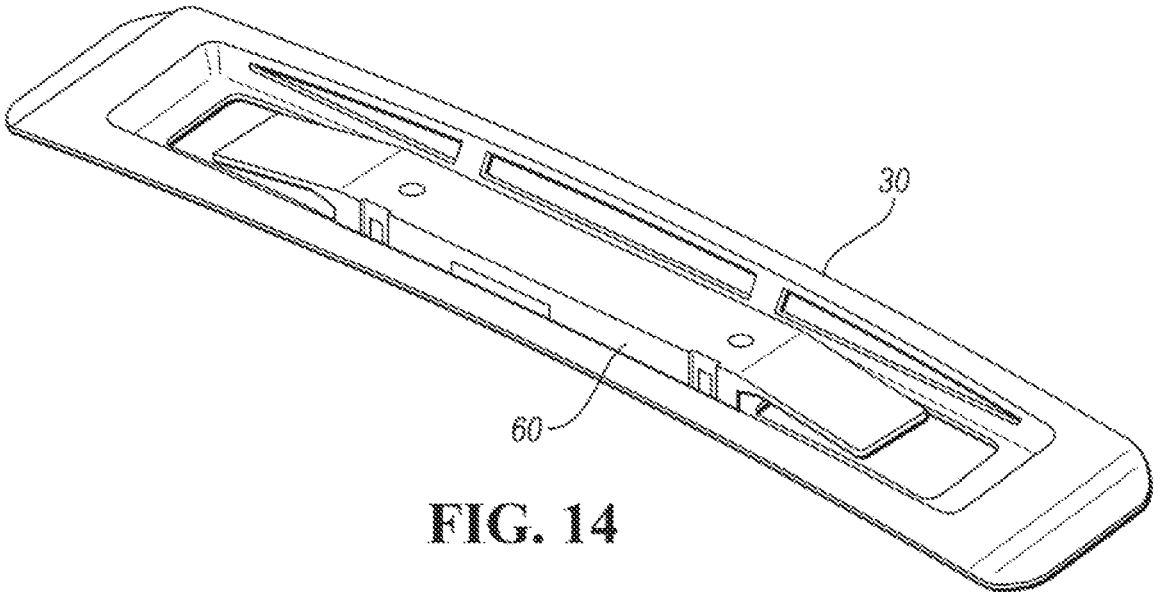
FIG. 14 is another perspective view similar to FIG. 13, with the TCU removed.
Figure 15:
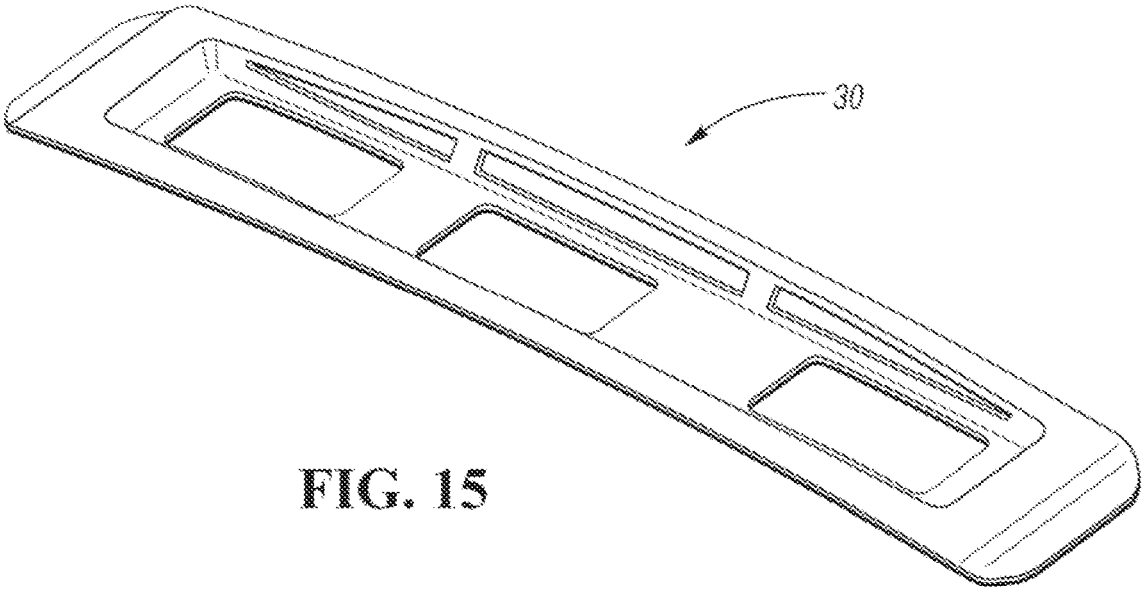
FIG. 15 is another perspective view similar to FIG. 14, with the TCU and the antenna module removed, illustrating the antenna carrier in isolation according to one embodiment.
Figure 17:
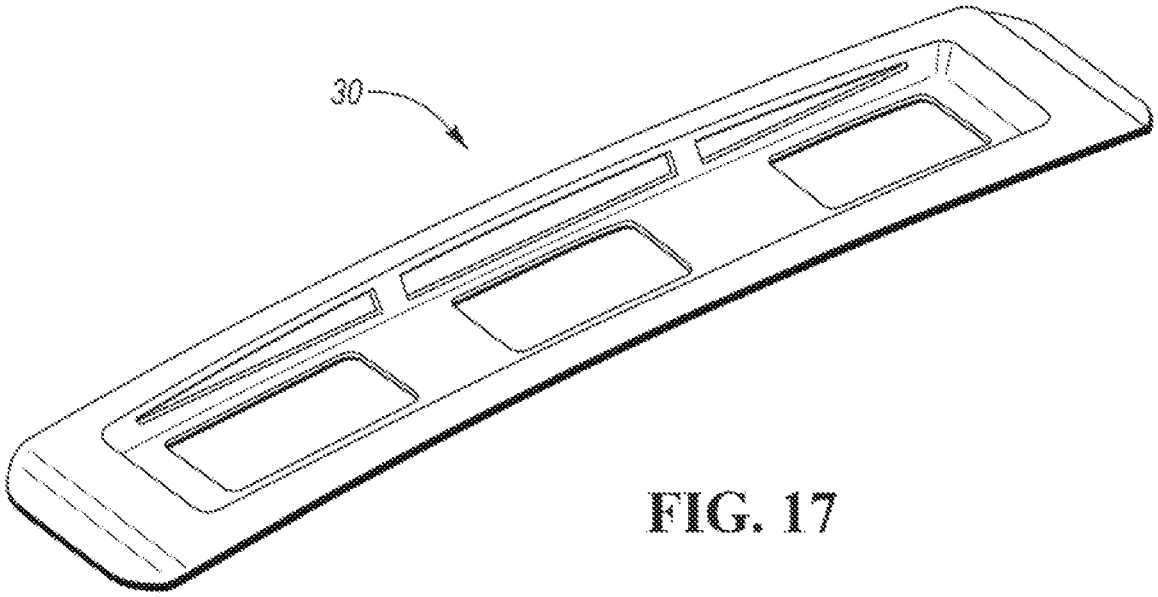
FIG. 17 is another top perspective view of the antenna carrier in isolation, according to one embodiment.

FIG. 14 shows the antenna carrier 30 and the connected antenna module 60 with the TCU removed. FIG. 15 shows the antenna carrier 30 with the antenna module 60 removed. FIGS. 16 and 17 show more views of the antenna carrier 30 in isolation.

Figure 18:
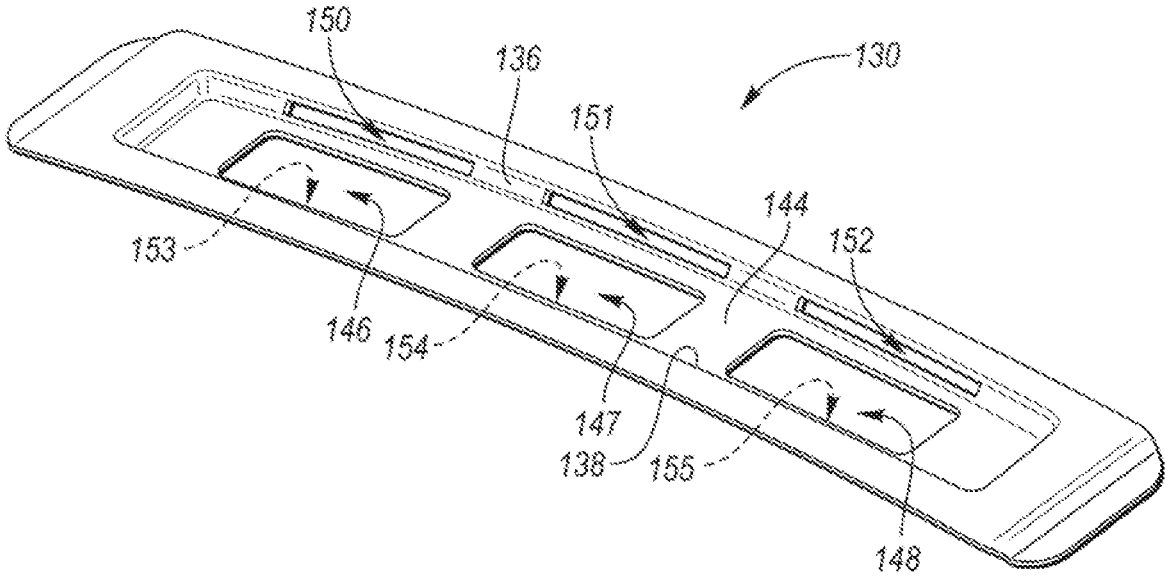
FIG. 18 is another perspective view of another embodiment of an antenna carrier.
Figure 19:
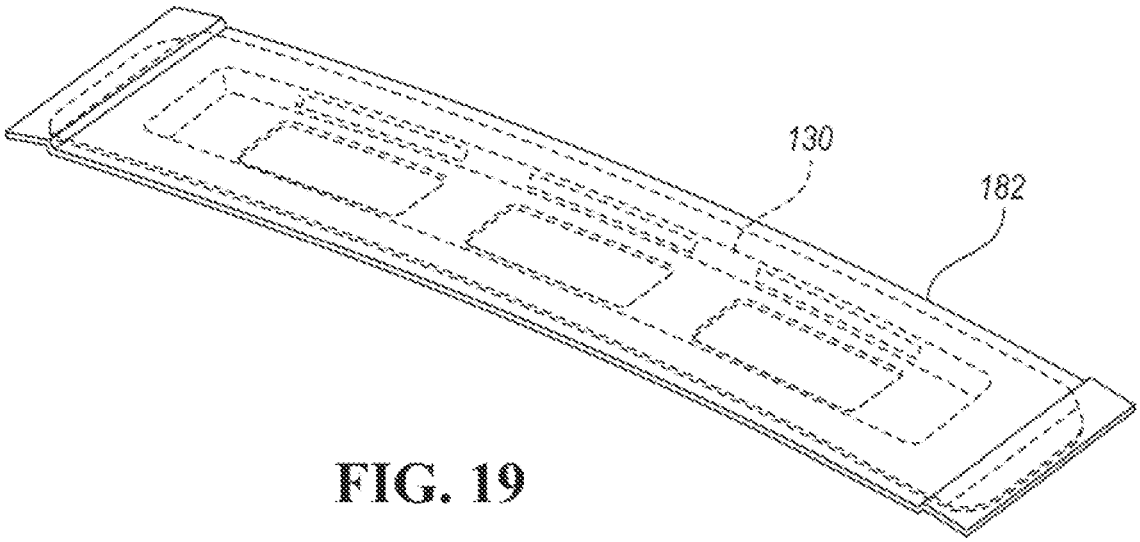
FIG. 19 is a top perspective view of the antenna carrier of FIG. 18 with a layer of protective material (e.g., glass or non-metal composite) covering the antenna carrier from above, according to one embodiment.
Figure 20:
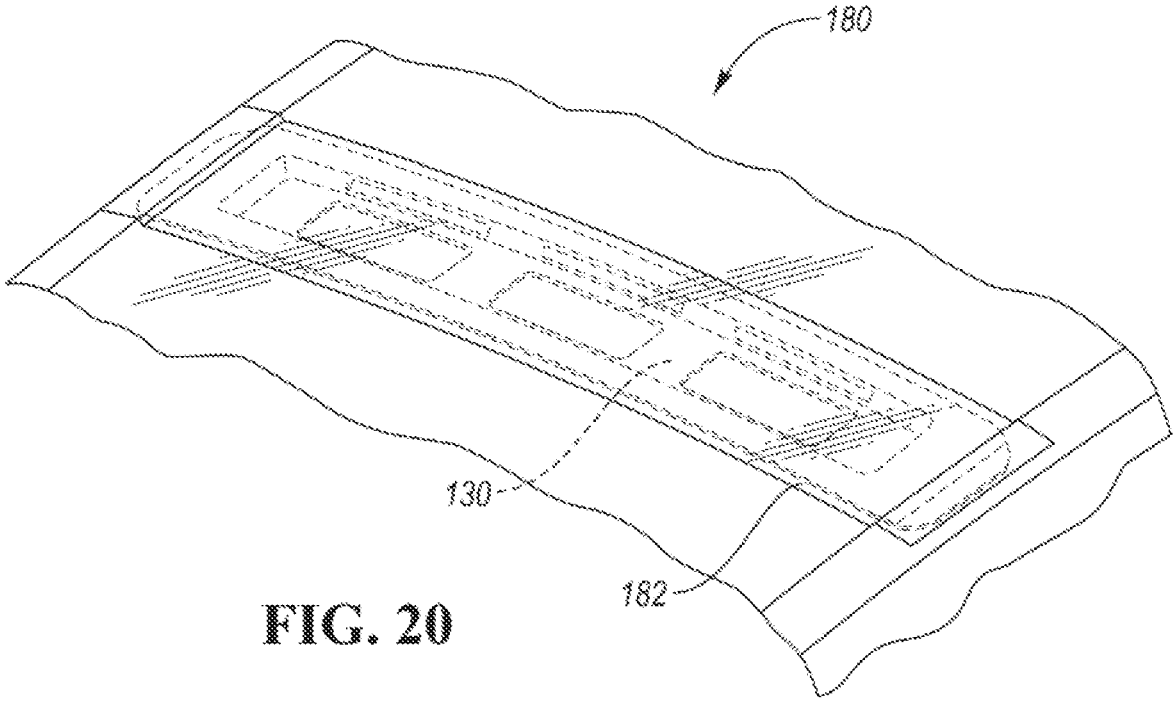
FIG. 20 is a top perspective view of the antenna carrier and protective material of FIG. 19, attached to a vehicle roof, according to one embodiment.

FIG. 18 illustrates another embodiment of the antenna carrier, with similar yet modified features shown with reference numbers that increase by 100. The antenna carrier 130 includes apertures in the lower surface 144 and front wall 136 and rear wall 138. In this embodiment, the apertures or openings 146, 147, 148, 150, 151, 152, 153, 154, 155 are shaped slightly different to give different signal tuning and beam forming characteristics. And, the regions between the apertures in the lower surface are identical in size in this embodiment. FIG. 19 shows the antenna carrier 130 provided with a region 182 placed above, such as darkened, low-transparency glass or non-metal composite. FIG. 20 shows the covered antenna carrier 130 attached to a vehicle roof structure 180.

While the Figures illustrate the antenna carrier 30 in one orientation relative to the vehicle roof, it should be understood that the antenna carrier 30 can be inverted relative to the vehicle roof. In other words, the upper flange 32 may be located on a lower side of the antenna carrier 30 rather than the upper side. In this embodiment, the flange 32 can be connected to underlying structure in the roof (e.g., an inner roof panel, etc.).

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

What is claimed is:

1. An antenna carrier for carrying high-frequency antennas and supporting a vehicle roof, the antenna carrier comprising:

a lower surface defining a first plurality of apertures;

a front wall extending upward from the lower surface and defining a second plurality of apertures therein;

a rear wall extending upward from the lower surface and defining a third plurality of apertures therein, wherein the third plurality of apertures are present in over 50 percent of a surface area of the rear wall;

a pair of opposing side walls extending upward from the lower surface;

wherein the lower surface, the front wall, the rear wall, and the side walls cooperate to define a pocket configured to receive an antenna module; and wherein the front wall, the rear wall, and the side walls end at a common upper flange that defines an upper perimeter of the antenna carrier that is configured to engage an underside of a vehicle roof.

2. The antenna carrier of claim 1, wherein the pair of opposing side walls do not have apertures.

3. The antenna carrier of claim 1, wherein the first plurality of apertures includes a first aperture separated from a second aperture by a first distance, and a third aperture separated from the second aperture by a second distance that exceeds the first distance.

4. The antenna carrier of claim 1, wherein the first plurality of apertures are present in over 50 percent of a surface area of the lower surface, and the second plurality of apertures are present in over 50 percent of a surface area of the front wall.

5. The antenna carrier of claim 1, wherein the antenna carrier is made of a composite material.

6. The antenna carrier of claim 1, wherein at least one of the second plurality of apertures is triangular or wedge-shaped.

7. A high-frequency antenna assembly configured to attach to a roof of a vehicle, the high-frequency antenna assembly comprising:

an antenna carrier configured to extend width-wise across the vehicle roof, the antenna carrier including:

an upper flange configured to engage an underside of the vehicle roof in a face-to-face relationship, and a plurality of walls extending downward from the upper flange and ending in a lower surface, the lower surface including a plurality of apertures, wherein the walls and lower surface cooperate to define a pocket in the antenna carrier; and a high-frequency antenna module mounted within the pocket of the antenna carrier and having an outer shell and a plurality of high-frequency antennas within the outer shell, each high-frequency antenna aligned with a respective one of the apertures in the lower surface of the antenna carrier;

wherein at least one of the plurality of walls of the antenna carrier is provided with a second plurality of apertures.

8. The high-frequency antenna assembly of claim 7, wherein the apertures are present in over 50 percent of a surface area of the lower surface.

9. The high-frequency antenna assembly of claim 7, wherein the antenna carrier is made of a composite material.

10. The high-frequency antenna assembly of claim 7, wherein the second plurality of apertures is present in over 50 percent of a surface area of the at least one of the plurality of walls.

11. The high-frequency antenna assembly of claim 7, wherein at least one of the second plurality of apertures is triangular or wedge-shaped.

12. The high-frequency antenna assembly of claim 7, wherein the plurality of walls includes a front wall and a rear wall, each of the front wall and the rear wall including apertures in a majority of their surface area.

13. The high-frequency antenna assembly of claim 12, wherein the plurality of walls includes a pair of side walls, wherein the side walls, the front wall, and the rear wall collectively end at the upper flange, and the upper flange is continuous about the pocket.

14. A support beam for a roof of an automotive vehicle, the support beam comprising:

an upper flange configured to engage a portion of the roof in a face-to-face engagement;

a pair of side walls extending downward from the upper flange;

a front wall and an opposing rear wall extending downward from the upper flange; and a lower surface connecting the pair of side walls, the front wall, and the rear wall, wherein the lower surface includes a plurality of apertures;

wherein the plurality of apertures exist in a majority of the lower surface along a first direction between the pair of side walls, and wherein the front wall and the rear wall include a second plurality of apertures.

15. The support beam of claim 14, wherein a width of each of the apertures is over 50 percent of a distance between the front wall and rear wall.

16. The support beam of claim 14, wherein the lower surface, the front wall, the rear wall, and the side walls collectively define a pocket recessed from the upper flange configured to house an antenna module for wireless communication with the vehicle.

17. The support beam of claim 16, wherein each of the apertures aligns with a respective wireless receiver or transceiver of the antenna module.

18. The support beam of claim 15, wherein the second plurality of apertures exists in a majority of a surface area of the front wall and rear wall.

* * * * *